US008366417B2

(12) United States Patent
Fan et al.

(10) Patent No.: US 8,366,417 B2
(45) Date of Patent: Feb. 5, 2013

(54) FAN AND FAN HOUSING CAPABLE OF ANTI-BACKFLOW

(75) Inventors: Jui-Ting Fan, Taoyuan Hsien (TW); Cheng-Shu Yu, Taoyuan Hsien (TW); Peng-Chu Tao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 658 days.

(21) Appl. No.: 11/907,363

(22) Filed: Oct. 11, 2007

(65) Prior Publication Data

US 2008/0112806 A1 May 15, 2008

(30) Foreign Application Priority Data

Nov. 10, 2006 (CN) ..... 95141667 A

(51) Int. Cl.
*F04B 35/04* (2006.01)

(52) U.S. Cl. ..... 417/423.14; 415/220; 417/423.9; 454/351

(58) Field of Classification Search ..... 417/423.9, 417/423.14, 423.1; 415/213.1, 220; 454/259, 454/347, 351, 352

See application file for complete search history.

(56) References Cited

U.S. PATENT DOCUMENTS

| | | | | | |
|---|---|---|---|---|---|
| 2,252,179 | A * | 8/1941 | Hueglin | ..... | 454/351 |
| 2,339,363 | A * | 1/1944 | Sutcliffe et al. | ..... | 454/351 |
| 2,676,530 | A * | 4/1954 | Bernstein | ..... | 454/351 |
| 4,967,490 | A * | 11/1990 | Berger et al. | ..... | 34/235 |
| 5,277,658 | A * | 1/1994 | Goettl | ..... | 454/259 |
| 5,735,137 | A * | 4/1998 | Kim | ..... | 454/351 |
| 6,005,770 | A * | 12/1999 | Schmitt | ..... | 454/184 |
| 6,190,122 | B1 * | 2/2001 | McCabe | ..... | 415/146 |

* cited by examiner

*Primary Examiner* — Peter J Bertheaud

(74) *Attorney, Agent, or Firm* — Birch, Stewart, Kolasch & Birch, LLP

(57) ABSTRACT

A fan housing capable of anti-backflow includes a frame and a plurality of anti-backflow sheets. The frame has a plurality of fixing parts disposed at an opening of an outlet side of the frame. The anti-backflow sheets are respectively pivoted to the fixing parts and cover the opening on the outlet side of the frame. A fan having the fan housing capable of anti-backflow is also disclosed.

7 Claims, 4 Drawing Sheets

2

FAN AND FAN HOUSING CAPABLE OF ANTI-BACKFLOW

CROSS REFERENCE TO RELATED APPLICATIONS

This Non-provisional application claims priority under 35 U.S.C. §119(a) on Patent Application No(s). 095141667 filed in Taiwan, Republic of China on Nov. 10, 2006, the entire contents of which are hereby incorporated by reference.

BACKGROUND OF THE INVENTION

1. Field of Invention

The invention relates to a fan and a fan housing thereof. In particular, the invention relates to a fan and a fan housing thereof that are capable of anti-backflow.

2. Related Art

As electronic devices provide better performance, operate at high frequencies and speeds and integrated in a smaller space, they generally generate more heat. The electronic devices are therefore likely to be unstable, lowering the reliability thereof. Therefore, heat dissipation becomes an important issue nowadays. Using a fan as a heat dissipating device is a common solution.

As shown in FIG. 1, a conventional anti-backflow fan 1 includes a fan body 11 and a fan housing 12. The fan body 11 is disposed inside the fan housing 12. Generally speaking, the fan body 11 has an impeller and a motor (not shown). The motor rotates the impeller to produce the airflow direction A as indicated in FIG. 1. The fan housing 12 is used to protect the fan body 11 and provide some fixing parts so that the magnetic conduction coils and circuit board of the motor can be fixed in the fan housing 12. Moreover, the fan housing 12 usually has several installation holes 121 for the user to fix the fan 1 on systems.

To prevent the airflow from leaking out of the air outlet 13 of the fan when the fan 1 becomes ineffective or non-operating, an anti-backflow device 14 is usually disposed on the air outlet 13 to stabilize the airflow field therein. In this case, the airflow is forbidden to enter the system via the air outlet 13.

The anti-backflow device 14 has a frame 141 and several anti-backflow sheets 142. The frame 141 is connected and fixed on the fan housing 12 by using the installation holes 121. The anti-backflow sheets 142 are pivotally installed on the frame 141 and cover the air outlet 13. When the fan 1 operates, the airflow passes through the air outlet 13, pushes the anti-backflow sheets 142 and then goes out. When the fan 1 stops operating, the anti-backflow sheets 142 cover the air outlet 13 to prevent backflows. However, although the anti-backflow device 14 can avoid backflows and thus stabilize the airflow field inside the system, the anti-backflow device 14 often uses the installation holes 121 of the fan 1 to connect to the fan housing 12. In that case, the installation holes 121 are not allowable for the user to use. The use of the fan 1 is thus limited. In addition, the anti-backflow device 14 and the fan housing 12 are two separate pieces. Not only are they likely to depart from each other, it also takes more product cost and time.

Therefore, it is desirable to provide an anti-backflow fan and the fan housing thereof to prevent backflows. The installation holes of the fan can be preserved for the user to use without increasing the size of the fan. The production cost and time can be significantly reduced, and the entire performance of the fan can be enhanced.

SUMMARY OF THE INVENTION

In view of the foregoing, the invention is to provide an anti-backflow fan that can prevent backflows and have installation holes available for the user to use. Thus, the production cost and time can be significantly reduced, and the entire performance of the fan can be enhanced.

To achieve the above, the invention discloses a fan housing including a frame and a plurality of anti-backflow sheets. The frame has an opening on an outlet side and a plurality of fixing parts located at the opening on the outlet side. The anti-backflow sheets are respectively pivoted on the fixing parts and cover the opening on the outlet side.

To achieve the above, the invention also discloses a fan including a fan housing and a fan body. The fan housing includes a frame and a plurality of anti-backflow sheets. The frame has an opening on an outlet side and a plurality of fixing parts disposed at the opening on the outlet side. The anti-backflow sheets are respectively pivoted on the fixing parts for covering an opening on the outlet side. At least partial of the fan body is disposed inside the fan housing.

As mentioned above, the anti-backflow fan and fan housing of the invention have anti-backflow sheets connected to the fixing parts to cover the opening with the thicker fan housing. The installation holes are preserved for the user to use. In comparison with the prior art, the invention does not need to use any other components to prevent backflows. It can be applied to different size fans. Therefore, the fan of the invention can have wider applications. Moreover, the production cost and time can be reduced, and the performance of the fan can be increased.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
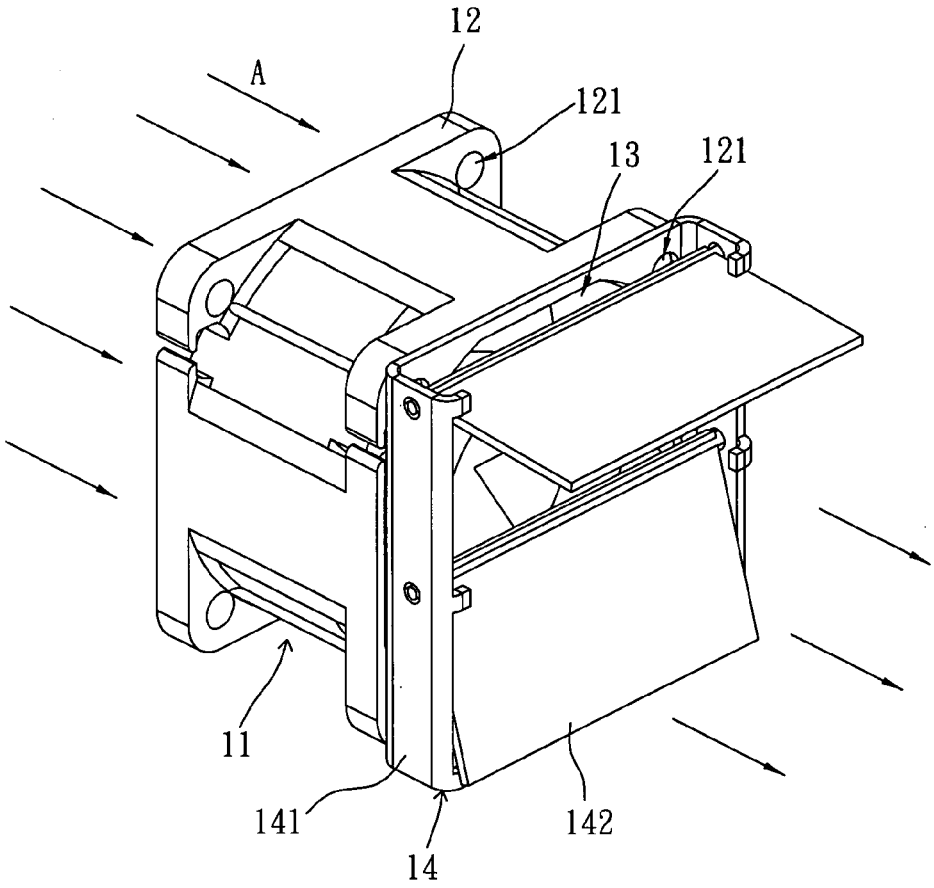
FIG. 1(PRIOR ART)
FIG. 1 is a schematic illustration of a conventional anti-backflow fan.
Figure 2:
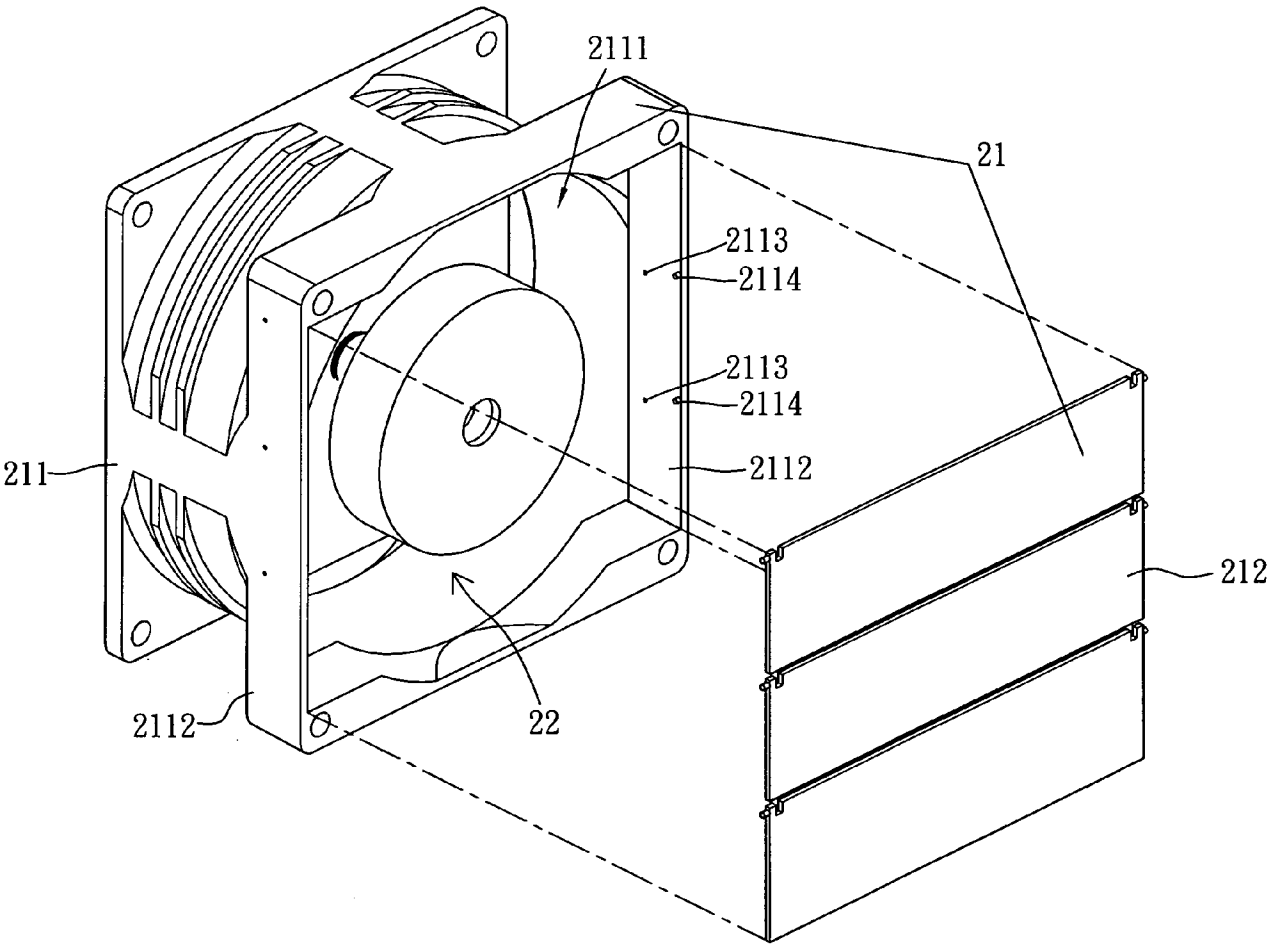
FIG. 2 is an exploded view of an anti-backflow fan and a fan housing thereof according to an embodiment of the invention.

As shown in FIG. 2, an anti-backflow fan 2 according to an embodiment of the invention includes a fan housing 21 and a fan body 22. The fan body 22 is at least partially disposed inside the fan housing 21. In particular, the fan housing 21 has a frame 211 and at least one anti-backflow sheet 212. The frame 211 has an opening 2111 on an outlet side of the fan housing 21. Two supporting parts 2112 are provided on two opposite sides of the opening 2111. The frame 211 further has several fixing parts 2113 symmetrically disposed on the supporting parts 2112. The anti-backflow sheets 212 are respectively pivoted on the fixing parts 2113 and cover the opening 2111 on the outlet side of the frame 211.

Figure 3:
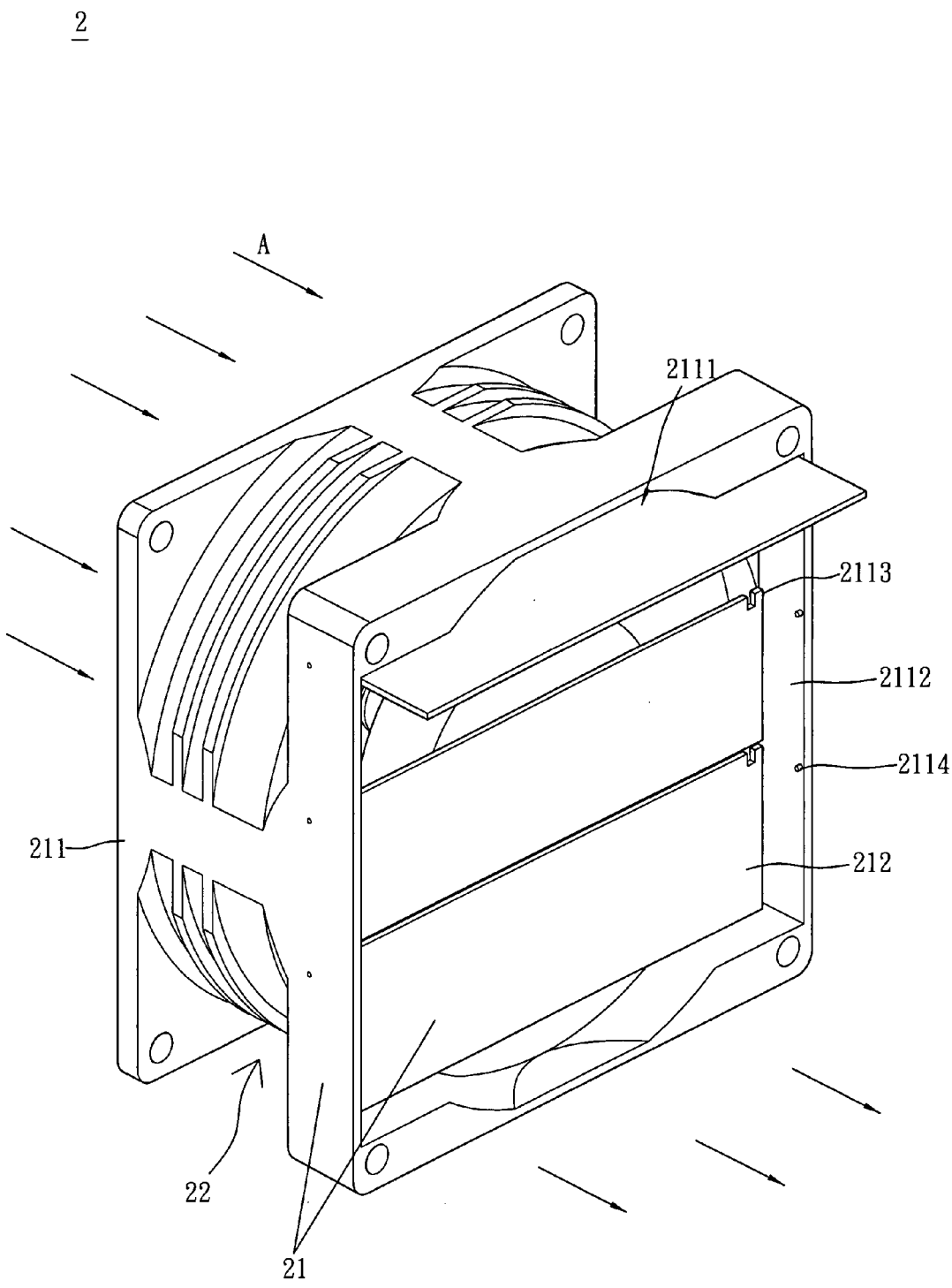
FIG. 3 is a schematic illustration showing the assembling and action of the anti-backflow fan and fan housing according to the embodiment of the invention.

As shown in FIG. 3, the arrows show the airflow direction A, and the anti-backflow sheets 212 are pivotally installed on the fixing parts 2113 to cover the opening 2111. When airflow passes the opening 2111, the anti-backflow sheets 212 rotate around the fixing parts 2113. When no airflow passes the opening 2111, the anti-backflow sheets return to the original positions to cover the opening 2111 due to gravity.

In order to prevent the anti-backflow sheets 212 from exceeding a maximum stroke and being unable to return to their original positions, several stopping elements 2114 are provided at the supporting parts 2112 to restrict their maximum strokes. In this embodiment, the stopping element 2114 is a protruding part connected to the corresponding supporting part 2112. The stopping elements 2114, the frame 211 and the fixing parts 2113 can also be formed as a single unit. When there is airflow, the anti-backflow sheets 212 reach their maximum strokes, and they are blocked by the stopping elements 2114. Therefore, when there is no airflow, the anti-backflow sheets 212 can go back to their original positions under the influence of gravity.

Figure 4:
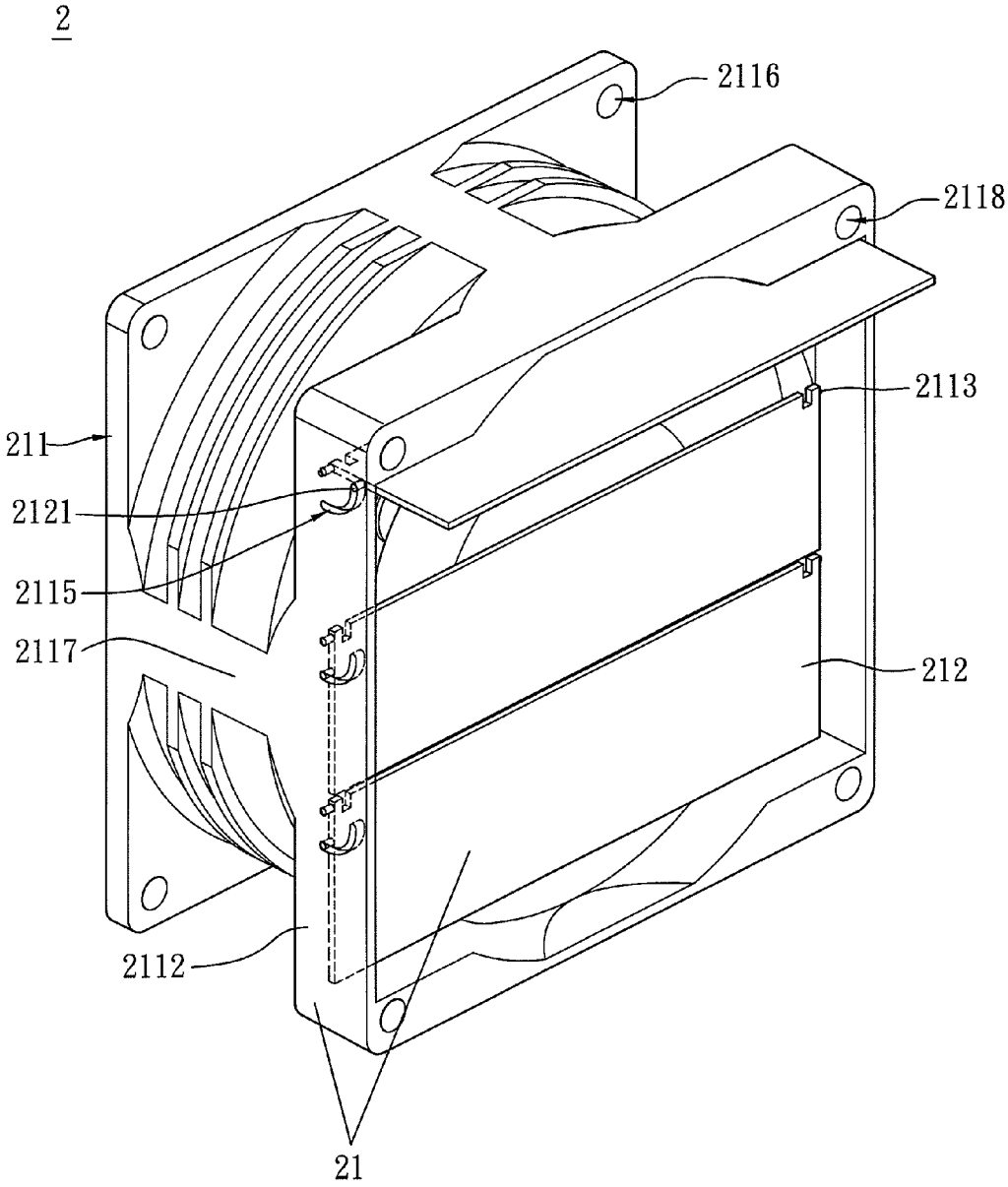
FIG. 4 is a schematic illustration showing that grooves are formed to restrict the maximum strokes of the anti-backflow sheets in the invention.

Please refer to FIG. 4. Another way to restrict the maximum strokes of the anti-backflow sheets 212 is to form a groove 2115 on the fixing parts 2113. A protruding element 2121 is then provided on the anti-backflow sheet 212 corresponding to the groove 2115. By requiring the protruding element 2121 to move within the groove 2115, the maximum stroke of each anti-backflow sheet 212 can be limited by the length of the groove 2115. At least two supporting parts 2112 are provided around the opening, and the main part 2117 and the supporting parts 2112 are undetachable as a single unit.

The frame 211 has several installation holes 2116 for the user to fix the fan 2 on a system. Since the anti-backflow sheets 212 are pivotally installed on the fixing parts 2113 directly, the installation holes 2116 can be preserved for the user to use. In addition, the frame 211 has at least one uncovered installation hole 2118 disposed on the supporting parts 2112, and the uncovered installation hole 2118 is preserved for an external device to engage with on the outlet side of the fan housing 21.

It should be noted that the invention does not limit the shape or size of the fan housing 21, and neither the type nor function of the fan body 22 is restricted. For example, the fan can be an axial-flow fan or a centrifugal fan.

In summary, the anti-backflow fan and fan housing of the invention have anti-backflow sheets pivoted on the fixing parts due to the thicker fan housing. The installation holes are preserved for the user to use. In comparison with the prior art, the invention does not need to use any other components to prevent backflows. It can be applied to different size fans. Therefore, the fan of the invention can apply in more fields. Moreover, the production cost and time can be reduced, and the performance of the fan can be increased.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan housing comprising:

a frame; the frame comprising:

a main part;

an opening on an outlet side of the frame;

at least two supporting parts provided around the opening, the main part and the supporting parts being undetachable as a single unit; wherein the supporting parts extend from the main part to the outlet side of the frame in an axial direction;

at least two fixing parts disposed on the supporting parts;

at least two grooves defined on the supporting parts;

at least one uncovered installation hole defined on the supporting parts and preserved for an external device to engage with on the outlet side of the frame;

at least one anti-backflow sheet pivotally installed on the at least two fixing parts directly for covering the opening; and at least two protrusions disposed on the at least one anti-backflow sheet, wherein the at least two protrusions move within the at least two grooves, and the length of the at least two grooves restricts the maximum stroke of the at least one anti-backflow sheet such that the at least one anti-backflow sheet does not obstruct the at least one uncovered installation hole.

2. The fan housing of claim 1, wherein the at least two supporting parts are disposed on opposite sides of the opening and the at least two fixing parts are disposed symmetrically on the supporting parts.

3. The fan housing of claim 1, wherein the main part completely surrounds a fan body, and the at least one anti-backflow sheet is accommodated in a space defined by the supporting parts.

4. A fan comprising:

a fan housing comprising a frame, at least one anti-backflow sheet and at least two protrusions disposed on the at least one anti-backflow sheet, wherein the frame comprises:

a main part;

an opening on an outlet side of the frame;

at least two supporting parts provided around the opening, the main part and the supporting parts being undetachable as a single unit; wherein the supporting parts extend from the main part to the outlet side of the frame in an axial direction;

at least two fixing parts disposed on the supporting parts;

at least two grooves defined on the supporting parts;

at least one uncovered installation hole defined on the supporting parts and preserved for an external device to engage with on the outlet side of the frame;

wherein the at least one anti-backflow sheet is pivotally installed on the at least two fixing parts directly for covering the opening;

wherein the at least two protrusions move within the at least two grooves, and the length of the at least two grooves restricts the maximum stroke of the at least one anti-backflow sheet such that the at least one anti-backflow sheet does not obstruct the at least one uncovered installation hole; and a fan body disposed on or in the fan housing.

5. The fan of claim 4, wherein the at least two supporting parts are disposed on opposite sides of the opening and the at least two fixing parts are disposed symmetrically on the supporting parts.

6. The fan of claim 4, wherein the fan is an axial-flow fan or a centrifugal fan.

7. The fan of claim 4, wherein the main part completely surrounds the fan body, and the at least one anti-backflow sheet is accommodated in a space defined by the supporting parts.

* * * * *